US008127579B2

(12) United States Patent
Mannella

(10) Patent No.: US 8,127,579 B2
(45) Date of Patent: Mar. 6, 2012

(54) UNIVERSAL LOCK CYLINDER

(75) Inventor: Eugenio Mannella, Newport Beach, CA (US)

(73) Assignee: Newfrey LLC, Newark, DE (US)

( * ) Notice: Subject to any disclaimer, the term of this patent is extended or adjusted under 35 U.S.C. 154(b) by 1855 days.

(21) Appl. No.: 10/797,884

(22) Filed: Mar. 10, 2004

(65) Prior Publication Data

US 2005/0199027 A1 Sep. 15, 2005

(51) Int. Cl.
*E05B 17/04* (2006.01)

(52) U.S. Cl. ..... 70/379 R; 70/367; 70/375; 70/493

(58) Field of Classification Search ..... 70/379 R, 70/380, 381, 367, 370, 371, 373–375, 493
See application file for complete search history.

(56) References Cited

U.S. PATENT DOCUMENTS

| | | | | |
|---|---|---|---|---|
| 2,042,025 | A | 5/1936 | Schlage | |
| 2,348,135 | A * | 5/1944 | Jacobi | 70/379 R |
| 2,484,961 | A | 10/1949 | Russell et al. | |
| 3,046,777 | A | 7/1962 | Schlage | |
| 3,605,463 | A * | 9/1971 | Epstein | 70/493 |
| 4,068,510 | A * | 1/1978 | Neary | 70/379 R |
| 4,328,690 | A | 5/1982 | Oliver | |
| 4,444,033 | A | 4/1984 | Deckert | |
| 4,663,953 | A | 5/1987 | Fish et al. | |
| 4,672,828 | A | 6/1987 | Theriault | |
| 4,761,978 | A * | 8/1988 | Walla | 70/367 |
| 4,793,166 | A | 12/1988 | Marks | |
| 4,802,352 | A | 2/1989 | Andreoli | |
| 4,926,670 | A | 5/1990 | Deforrest, Sr. | |
| 5,161,397 | A | 11/1992 | Raybary | |
| 5,481,890 | A | 1/1996 | Millman | |
| 5,884,512 | A | 3/1999 | Wayne | |
| 6,105,405 | A | 8/2000 | Westwinkel | |
| 6,109,080 | A | 8/2000 | Chen et al. | |
| 6,145,356 | A * | 11/2000 | Thwing | 70/389 |
| 6,223,567 | B1 | 5/2001 | Fadul | |
| 6,568,229 | B1 * | 5/2003 | Heinrich | 70/370 |
| 6,644,076 | B2 * | 11/2003 | Huang | 70/379 R |
| 2002/0073754 | A1 * | 6/2002 | Katagiri et al. | 70/379 R |

* cited by examiner

*Primary Examiner* — Suzanne D Barrett
(74) *Attorney, Agent, or Firm* — Carlson Gaskey & Olds P.C.

(57) ABSTRACT

A lock assembly includes a universal core assembly, which provides multiple engagement features to permit the core assembly to be mounted into various lock housings. A torque blade or a spindle assembly is received within a rear segment of the lock core to engage one of the engagement members depending upon the desire lock within which the core is to be mounted.

17 Claims, 7 Drawing Sheets

UNIVERSAL LOCK CYLINDER

BACKGROUND OF THE INVENTION

The present invention relates to a lock assembly, and more particularly to a mounting arrangement for a universal core assembly into multiple lock housings.

Numerous types of conventional lock assemblies are utilized for various applications. Homes and commercial establishments are protected predominantly by key-actuated pin tumbler locks. In a typical lock, a core assembly houses a rotational cylindrical plug having a longitudinally extending keyway. A driving member such as a cam is connected to the rear face of the plug. Rotation of the plug rotates the cam, which thereby rotates a driving member. The driving member actuates a bolt-throwing or latch-moving mechanism.

The interface between the plug and the case is called the shear line. A plurality of radially extending, parallel chambers is formed in the case and the plug. Spring-biased pins are disposed in each chamber. Under normal conditions, the drivers block the shear line, thereby preventing the plug from being rotated relative to the case. However, when a properly configured key is inserted into the keyway, the drivers and lower pins are moved so that the top of the lower pins and the bottom of the drivers meet at the shear line. The plug can then be rotated to cause rotation of the driving member and subsequent retraction or extension of the bolt or latch.

Locksmiths frequently must re-key or replace residential or commercial locks on short notice. To this end, interchangeable core assemblies are manufactured by various lock makers. Disadvantageously, the interchangeable core assemblies are relatively complicated. Typically, the interchangeable core assembly, even those from a single manufacture, is specific to a particular lock type and including mounting structure specific thereto. For example, a knob lock assembly, a lever lock assembly, and deadbolt lock assembly each utilize a core assembly and mounting arrangement particular to a knob, a lever, and a deadbolt, respectively. Such an arrangement complicates re-keying and replacement of residential and commercial locks.

Accordingly, it is desirable to provide an uncomplicated mounting arrangement for a core assembly that is readily mounted into multiple lock types.

SUMMARY OF THE INVENTION

The lock assembly according to the present invention provides a universal core assembly. The universal core assembly provides engagement features, which permit the core assembly to be mounted into various lock housings. A torque blade or a spindle assembly is received within a rear segment of the lock core depending upon the desired lock within which the core is to be mounted.

A rear segment of the plug includes a first engagement member arranged generally perpendicular to a second engagement member. In an assembled position for a deadbolt, a female portion of the torque blade is mounted over the second engagement member. In an assembled position for a lever or knob, a female portion of the spindle assembly is mounted over the first engagement member. Rotation of the plug rotates the torque blade or the spindle assembly to rotate the appropriate lock assembly.

The present invention therefore provides an uncomplicated mounting arrangement for a core assembly that is readily mounted into multiple lock types.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
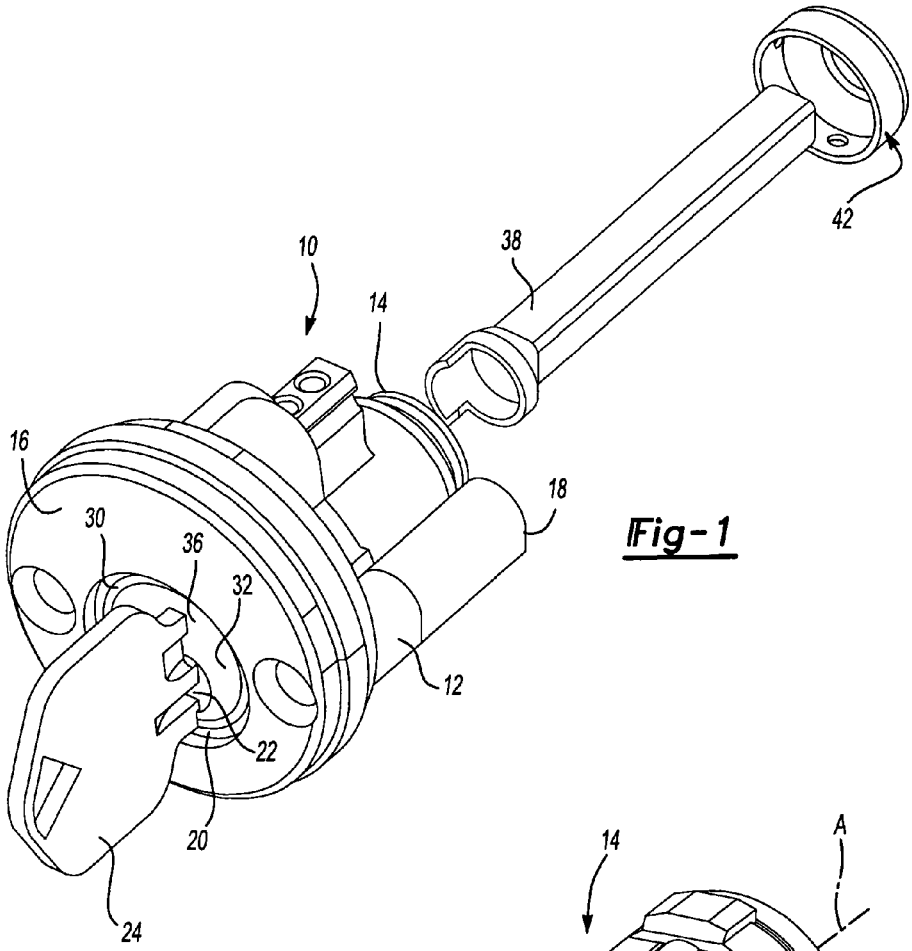
FIG. 1 is a front exploded perspective view of a deadbolt lock assembly according to the present invention.

FIG. 1 illustrates a general exploded perspective view of a lock assembly 10. The lock assembly generally includes a lock housing 12 and a core assembly 14. As will be further described, the core assembly 14 is a universal core assembly that provides engagement features, which permits the core assembly to be mounted into various lock housings. The housing 12 supports and protects the core assembly 14. Although a deadbolt housing is illustrated in this embodiment, it should be understood that other housings for other lock assemblies, such as a lever or knob, will also benefit from the present invention.

Figure 2:
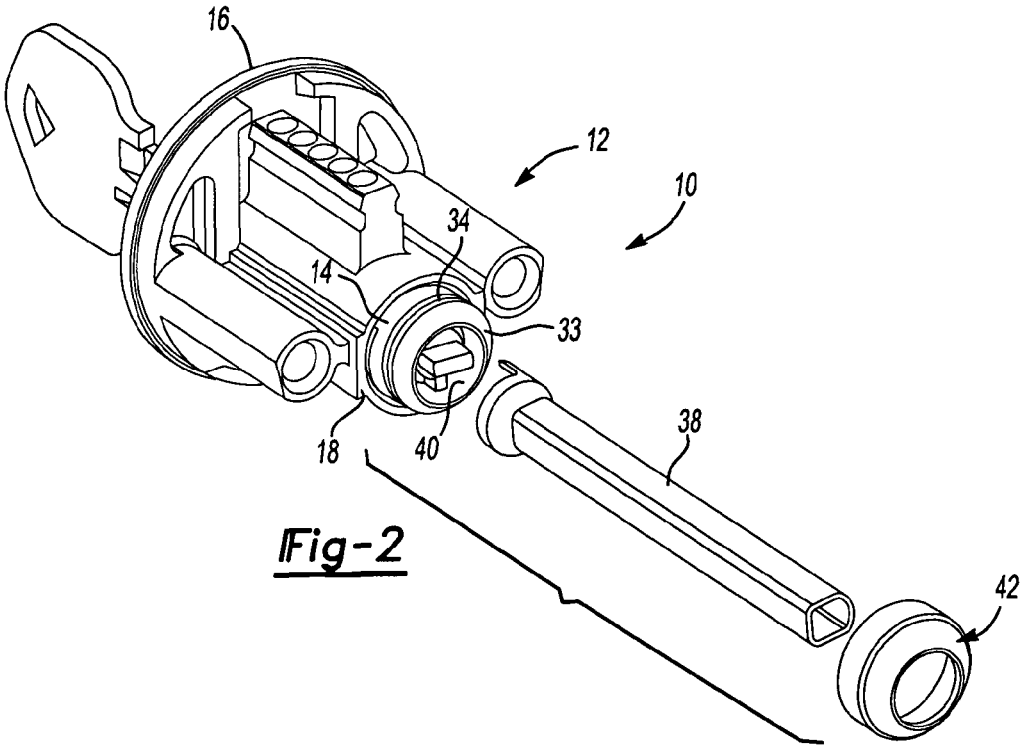
FIG. 2 is a rear exploded perspective view of a deadbolt lock assembly according to the present invention.

The housing 12 includes a front face 16 and a rear face 18 (FIG. 2). It should be understood that relative positional terms such as "forward," "aft," "upper," "lower," "above," "below," and the like are with reference to the normal operational attitude of the vehicle and should not be considered otherwise limiting. A longitudinally extending bore 20 opens through the front and rear faces 16, 18 into which the core assembly 14 is mounted.

Figure 3:
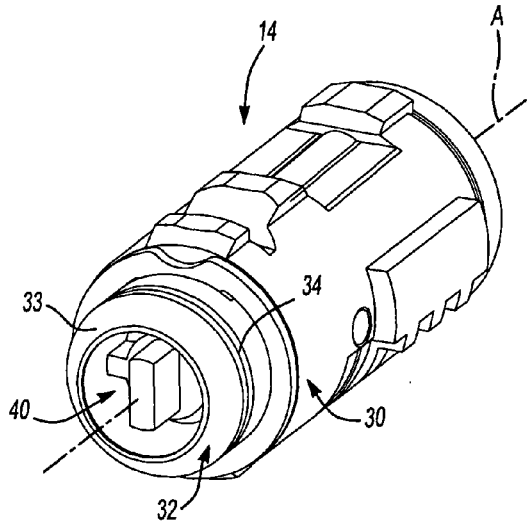
FIG. 3 is a rear perspective view of a core assembly.

Referring to FIG. 2, the core assembly 14 includes a barrel 30 and a plug 32 (FIG. 3). A keyway 22 (FIG. 1) is defined in a front face 36 of the plug 32 to permit insertion of a key 24 such that the plug 32 can be rotated to operate the lock. Operation of the key to pin arrangement may take various conventional forms and need not be described in detail herein.

Figure 4:
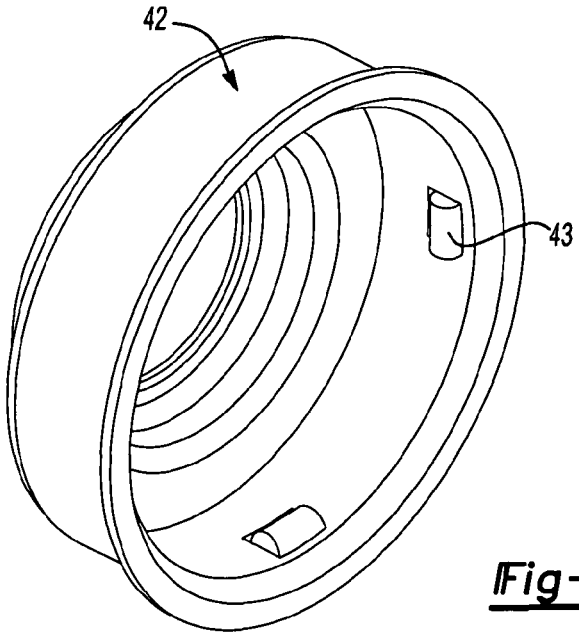
FIG. 4 is a rear perspective view of a retainer.
Figure 5:
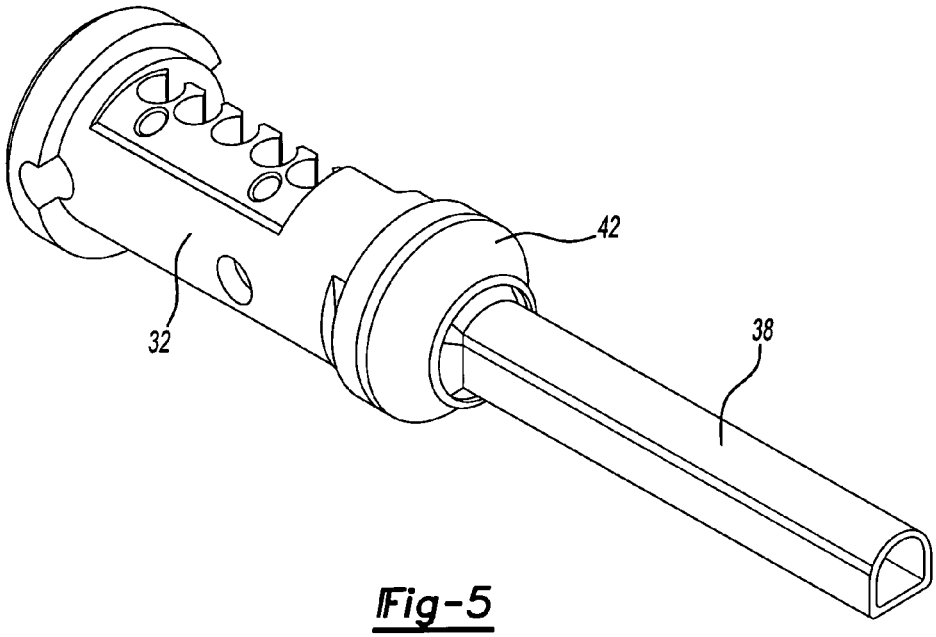
FIG. 5 is a rear assembled perspective view of the deadbolt lock assembly of FIGS. 1 and 2.

For a deadbolt lock assembly, a torque blade 38 is received within a rear segment 40 of the plug 32. The rear segment 40 defines a skirt 33 having a circumferential groove 34 to receive fasteners 43 which extend from within a frustum-conically shaped retainer 42 (FIG. 4) to retain the torque blade 38 within the rear segment 40 (FIG. 5). The skirt 33 preferably provides a counter bore to receive an end segment of the torque blade 38.

Figure 7:
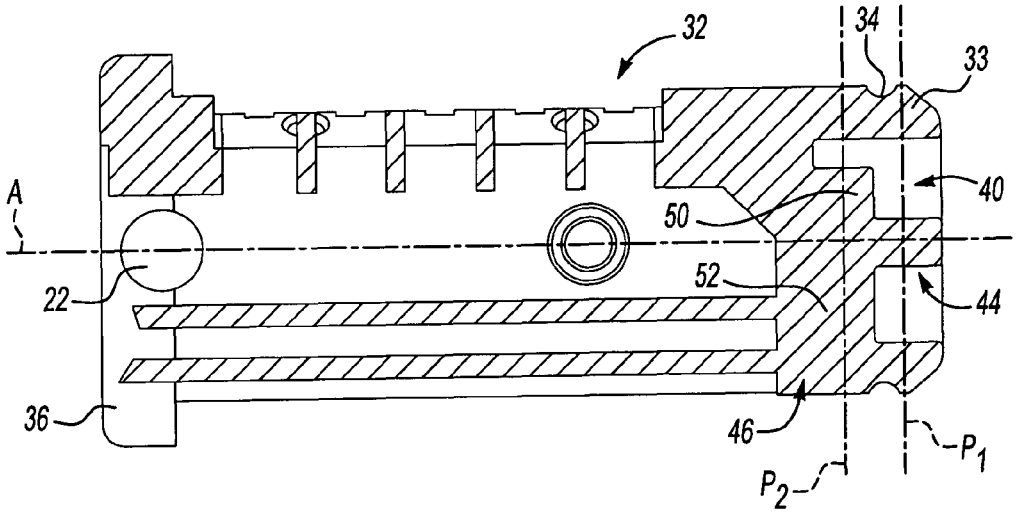
FIG. 7 is a side sectional view of a core assembly plug taken along the line 7-7 of FIG. 6.

Referring to FIG. 7, the plug 32 defines a longitudinal plug axis A. The rear segment 40 defines a first plane P1 parallel to a second plane P2. The planes P1, P2 are transverse and offset along the axis A (FIG. 7). A first engagement member 44 is located at least partially within the first plane P1 and a second engagement member 46 is at least partially located within the second plane P2. The first engagement member 44 is arranged generally perpendicular to the second engagement member 46. The first and second engagement member 44, 46 are preferably recessed within the skirt 33.

The first engagement member 44 is preferably a generally rectangular shaped member 48, which extends from a circular member 50. The second engagement member 46 includes the circular member 50 and a stop 52, which extends from the radial periphery thereof. The circular member 50 defines an inner diameter from which the stop 52 extends. The stop 52 extends from the periphery of the circular member 50 to define an outer diameter relative the inner diameter. That is, the stop 52 extends from the inner diameter defined by the circular member 50 to the outer diameter.

Figure 8:
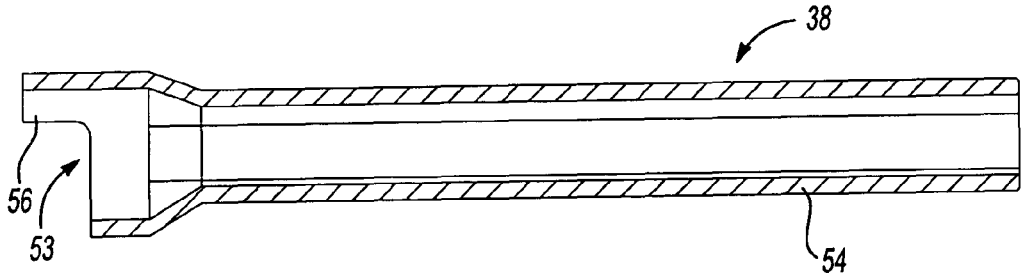
FIG. 8 is a side sectional view of a torque blade.
Figure 9:
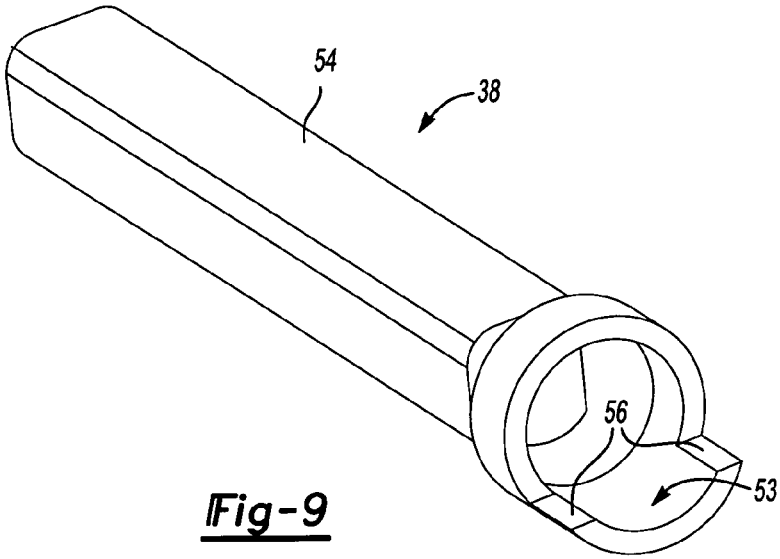
FIG. 9 is a perspective view of the torque blade of FIG. 8.

Referring to FIG. 8, the torque blade 38 is generally cylindrical. The torque blade 38 preferably includes a female portion 53 and a rod portion 54. The female portion 52 is preferably of a larger diameter than the rod portion 54. The rod portion 54 typically engages an actuating plate (not shown) that extends through a latch bolt (not shown), which is conventional and need not be described in detail herein. The female portion 53 includes a stepped section 56 (FIG. 9).

Figure 6:
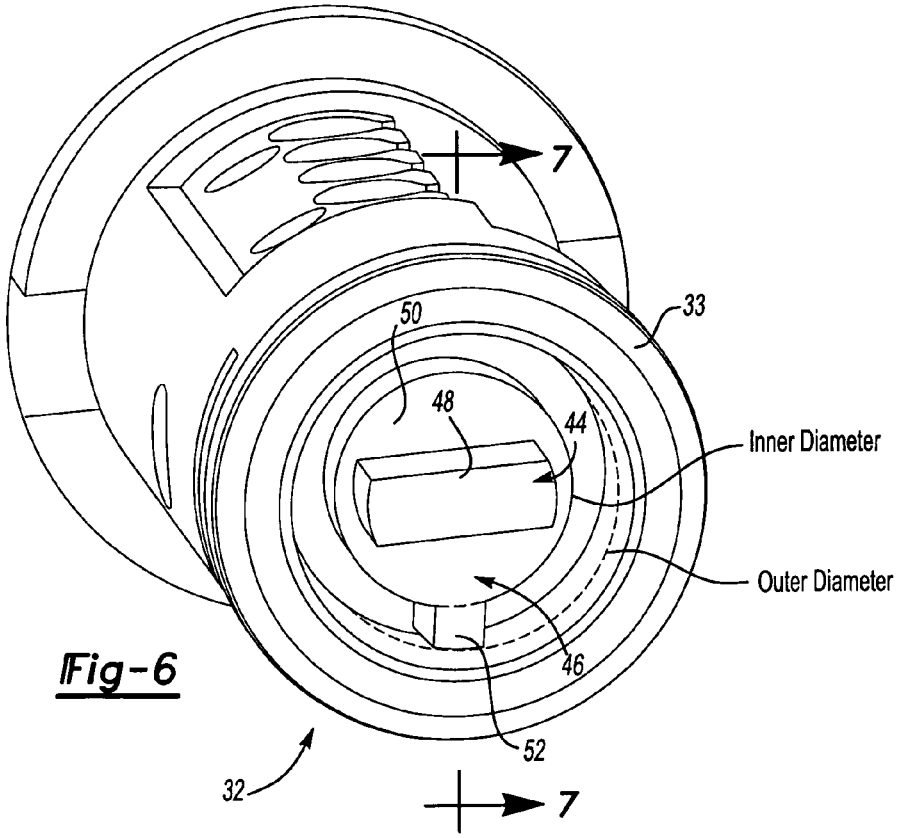
FIG. 6 is another rear perspective view of a core assembly.
Figure 10:
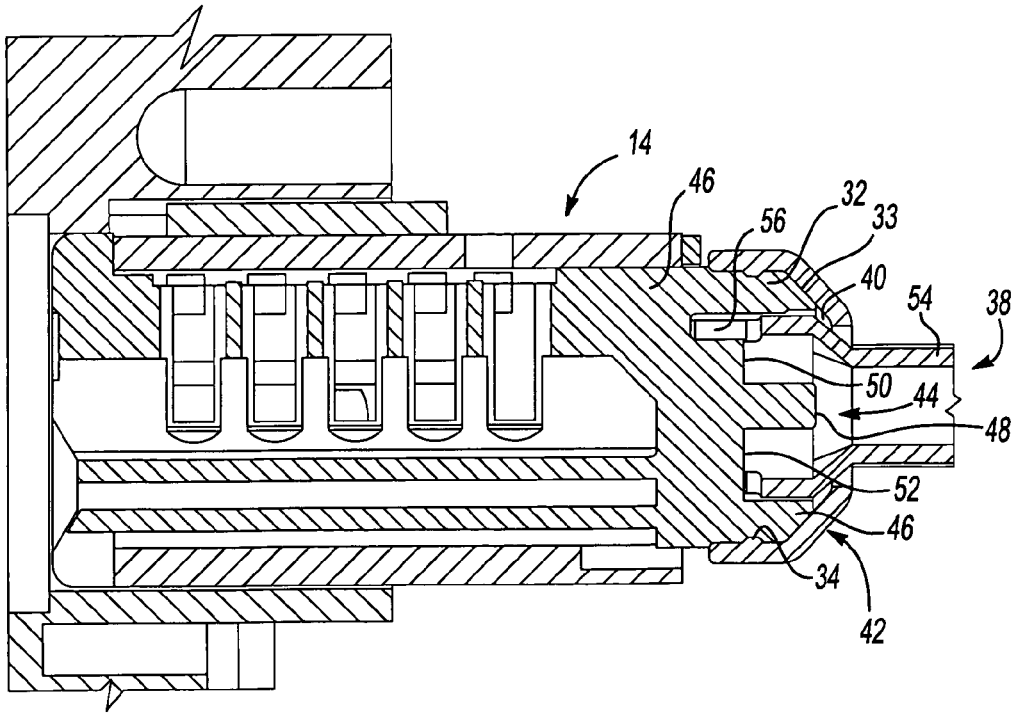
FIG. 10 is a section view of the torque blade mounted to the core assembly plug.

In an assembled position, the female portion 53 is mounted over the circular member 50 of the second engagement member 46. Rotation of the plug 32 within the barrel 30 rotates the second engagement member 46 into contact with the stepped section 56 of the female portion to rotate the torque blade 38. That is, the stop 52 (FIG. 6) is rotated into contact with stepped section 56 of the female portion 53, which is received at least partially over the circular portion 50 (FIG. 10).

Figure 11:
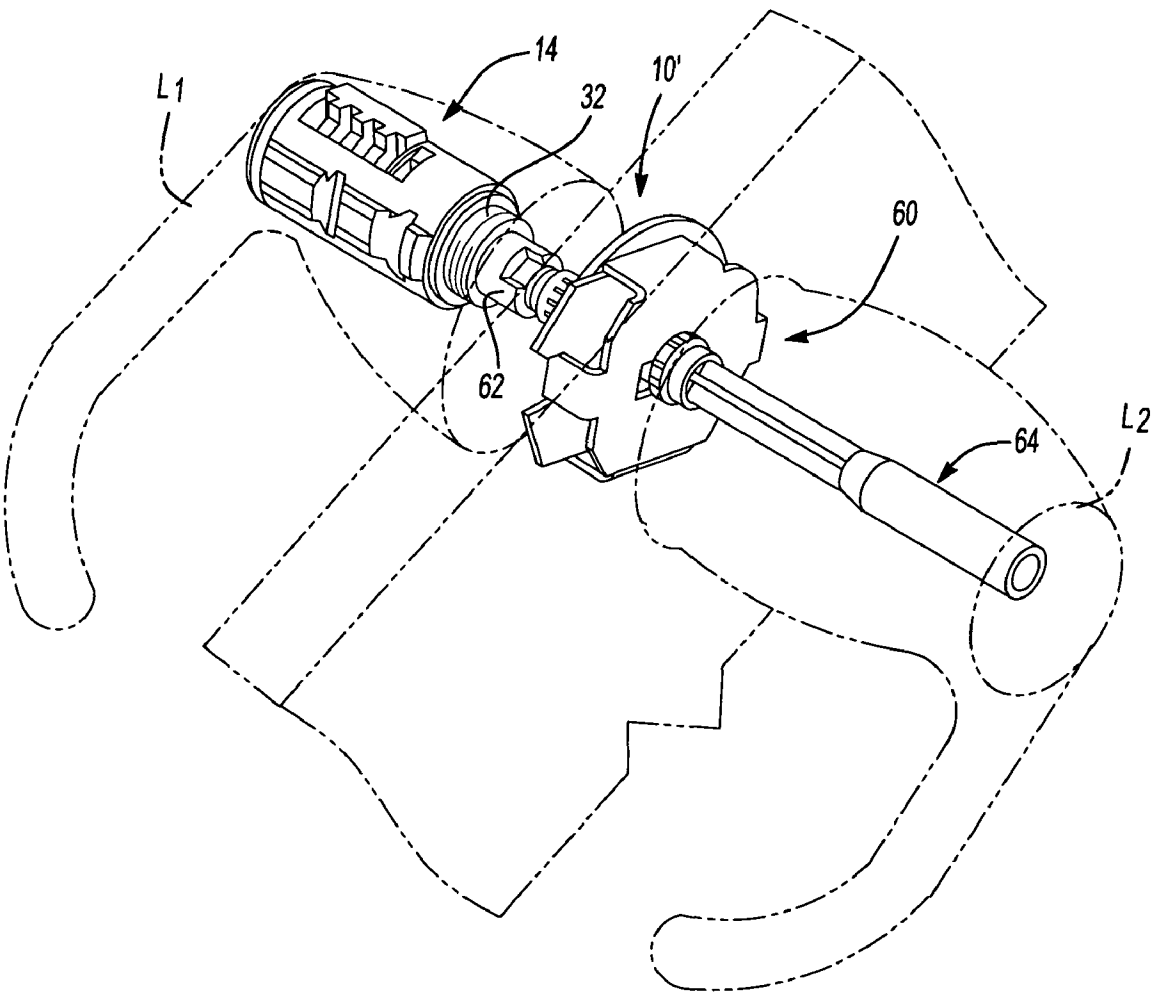
FIG. 11 is a rear perspective view of a knob/lever lock assembly according to the present invention.
Figure 12:
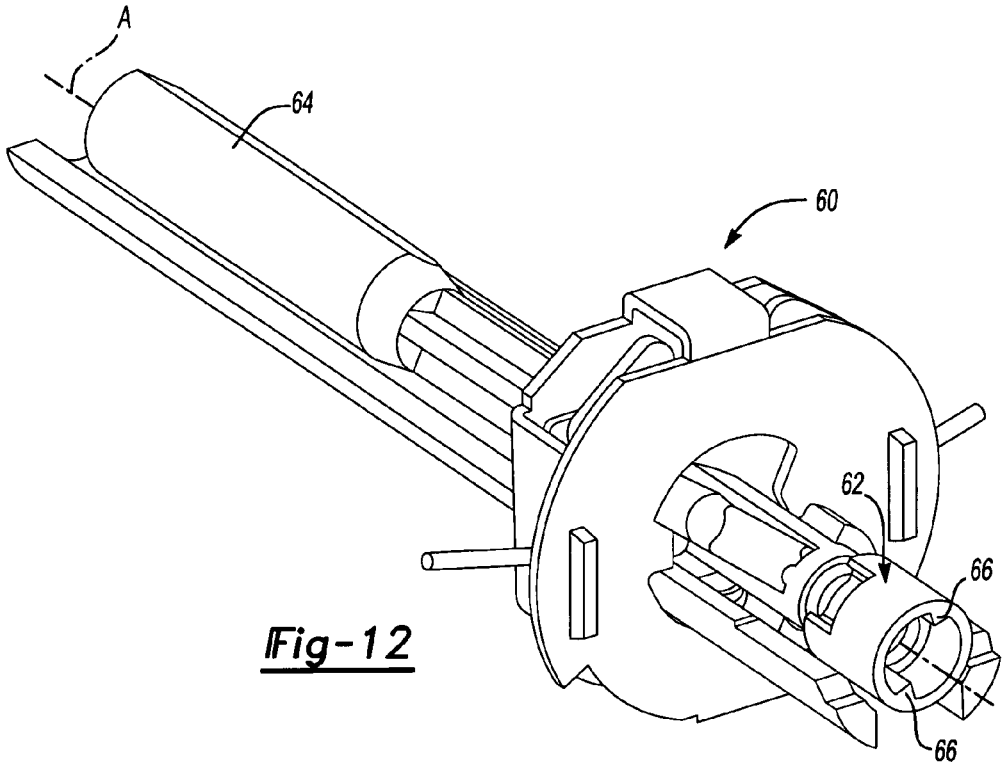
FIG. 12 is a rear perspective view of a spindle assembly according to the present invention.

Referring to FIG. 11, another lock assembly 10' may be provided by the core assembly 14. That is, the core assembly 14 is universal and, in addition to the deadbolt housing discussed above, is engageable with a spindle assembly 60 for a lever and knob rather than using the torque blade 38 of the FIG. 1 embodiment typical of the deadbolt. The core assembly 14 is typically mounted within a lever or knob L1 on one side of a door D (illustrated schematically) and the spindle assembly 60 passes through a the door D to mount a knob or lever L2, which are conventional and need not be described in greater detail herein. The spindle assembly 60 is generally cylindrical and preferably includes a female portion 62, which engages the plug 32 of the core assembly 14 (FIG. 11) and a rod portion 64, which mounts to the knob or lever L2 opposite the core assembly 14 (FIG. 11). The spindle assembly 60 is illustrated from the core assembly 14 side in FIG. 12.

The female portion 62 includes opposed spindle cams 66. The cams 66 are preferably axial partially triangular members, which extend toward axis A.

Figure 13:
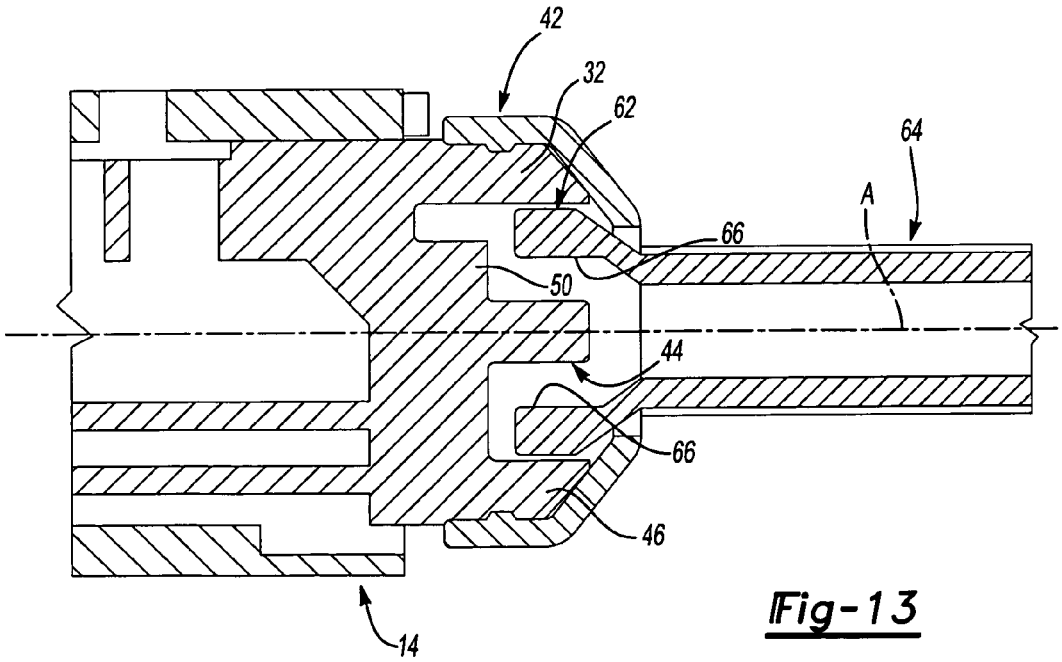
FIG. 13 is a section view of the spindle assembly mounted to the core assembly plug.

In an assembled position of this embodiment, the female portion 62 is mounted over the first engagement member 44. The cams 66 which define a smaller diameter within the female portion extend within an outer diameter defined by the first engagement member 44. That is, the rectangular shaped member 48 is rotated into contact with cams 66 of the female portion 62. Rotation of the plug 32 within the barrel 30 rotates the first engagement member 44 into contact with the cams 66 to rotate the spindle assembly 60 (FIG. 13). A single plug 32 may thereby be utilized for both the torque blade 38 and the spindle assembly 60.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A lock core assembly comprising:

a barrel which defines an axis; and a plug mountable for rotation within said barrel for rotation around said axis relative said barrel, said plug comprising an rear segment recessed within said plug which defines a first plane parallel to a second plane, said first plane and said second plane transverse and offset along said axis, a first engagement member at least partially within said first plane and a second engagement member at least partially within said second plane, said first engagement member perpendicular to said second engagement member.

2. The lock cylinder assembly as recited in claim 1, wherein said second engagement member comprises a stop that extends from a circular member defined at least partially around said axis, said circular member located at least partially within said second plane.

3. The lock cylinder assembly as recited in claim 2, wherein said circular member defines an inner diameter and said stop extends from said circular member transverse to said axis to define at least a portion of an outer diameter.

4. The lock cylinder assembly as recited in claim 1, wherein said plug defines a groove.

5. The lock cylinder assembly as recited in claim 4, further comprising a torque blade comprising a female end engageable with said rear segment.

6. The lock cylinder assembly as recited in claim 1, further comprising a spindle comprising a female end engageable with said rear segment.

7. The lock cylinder assembly as recited in claim 6, further comprising opposed spindle cams within said female end.

8. A lock core assembly comprising:

a barrel which defines an axis;

a plug mountable for rotation within said barrel for rotation around said axis relative said barrel, said plug defining a groove and comprising a rear segment which defines a first plane parallel to a second plane, said first plane and said second plane transverse and offset along said axis, a first engagement member at least partially within said first plane and a second engagement member at least partially within said second plane, said first engagement member perpendicular to said second engagement member;

a torque blade comprising a female end engageable with said rear segment; and a retainer mountable at least partially within said groove, said retainer axially retaining said torque blade to said rear segment.

9. The lock cylinder assembly as recited in claim 8, wherein said retainer is frustum-conically shaped.

10. A lock assembly comprising:

a lock housing;

a barrel which defines an axis, said barrel mountable within said housing;

a plug mountable for rotation within said barrel for rotation around said axis relative said barrel, said plug comprising a male rear segment;

a torque blade comprising a female end engageable with said male rear segment; and a retainer axially retaining said female end over said male rear segment.

11. A lock assembly comprising:

a lock housing;

a barrel which defines an axis, said barrel mountable within said housing;

a plug mountable for rotation within said barrel for rotation around said axis relative said barrel, said plug comprising a male rear segment recessed within said plug;

a torque blade comprising a female end engageable with said male rear segment; and a retainer axially retaining said female end over said male rear segment.

12. The lock assembly as recited in claim 11, wherein said male rear segment comprises a first engagement member perpendicular to a second engagement member.

13. The lock assembly as recited in claim 12, wherein first engagement member is axially displaced from said second engagement member.

14. The lock assembly as recited in claim 11, wherein said second engagement member extends from a circular member, said circular member defines an inner diameter and said second engagement member extends from said circular member transverse to said axis to define at least a portion of an outer diameter.

15. A lock assembly comprising:

a lock housing;

a barrel which defines an axis, said barrel mountable within said housing;

a plug mountable for rotation within said barrel for rotation around said axis relative said barrel, said plug comprising a male rear segment wherein said male end is recessed within said plug;

a torque blade comprising a female end engageable with said male rear segment; and a retainer axially retaining said female end over said male rear segment and engaging a groove defined about said plug.

16. A lock assembly comprising:

a lock housing;

a barrel which defines an axis, said barrel mountable within said housing;

a plug mountable for rotation within said barrel for rotation around said axis relative said barrel, said plug comprising a male rear segment; and a spindle comprising a female end with opposed cams engageable with said male rear segment, wherein said male rear segment is recessed within said plug.

17. The lock assembly as recited in claim 16, wherein said retainer is a frustum-conically shaped retainer.

* * * * *